US011576463B2

(12) United States Patent
Bunnell et al.

(10) Patent No.: US 11,576,463 B2
(45) **Date of Patent: *Feb. 14, 2023**

(54) FOOTWEAR SOLE STRUCTURE WITH COMPRESSION GROOVES AND NONLINEAR BENDING STIFFNESS

(71) Applicant: NIKE, Inc., Beaverton, OR (US)

(72) Inventors: Dennis D. Bunnell, Vacouver, WA (US); Bryan N. Farris, North Plains, OR (US); Austin Orand, Portland, OR (US); Alison Sheets-Singer, Portland, OR (US); Aaron B. Weast, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/208,912

(22) Filed: Mar. 22, 2021

(65) Prior Publication Data

US 2021/0204647 A1 Jul. 8, 2021

Related U.S. Application Data

(62) Division of application No. 15/266,664, filed on Sep. 15, 2016, now Pat. No. 10,986,893.

(Continued)

(51) Int. Cl.

| | |
|---|---|
| ***A43B 13/14*** | (2006.01) |
| ***A43B 13/18*** | (2006.01) |
| ***A43B 13/12*** | (2006.01) |
| ***A43B 13/04*** | (2006.01) |
| ***A43B 17/02*** | (2006.01) |

(Continued)

(52) U.S. Cl.

CPC ..... *A43B 13/141* (2013.01); *A43B 13/04* (2013.01); *A43B 13/12* (2013.01); *A43B 13/127* (2013.01); *A43B 13/181* (2013.01); *A43B 13/186* (2013.01); *A43B 13/188* (2013.01); *A43B 13/223* (2013.01); *A43B 17/02* (2013.01);

(Continued)

(58) Field of Classification Search

CPC ... A43B 13/141; A43B 13/188; A43B 13/127; A43B 13/186; A43B 13/04; A43B 13/12; A43B 13/223

USPC ..... 36/3 B, 25 R, 24.5, 43, 44

See application file for complete search history.

(56) References Cited

U.S. PATENT DOCUMENTS 4,476,638 A * 10/1984 Quacquarini ..... A43B 7/28 36/31
4,779,361 A * 10/1988 Kinsaul ..... A43B 13/16 36/102

(Continued)

FOREIGN PATENT DOCUMENTS

EP 0123550 A1 * 10/1984 ..... A43B 23/08
EP 997081 A1 * 5/2000 ..... A43B 17/00

(Continued)

*Primary Examiner* — Sharon M Prange
(74) *Attorney, Agent, or Firm* — Quinn IP Law

(57) ABSTRACT

A sole structure for an article of footwear comprises a sole plate that has a forefoot portion with a foot-facing surface. The sole plate has at least one groove extending at least partially transversely in the foot-facing surface. The at least one groove is open when the sole structure is dorsiflexed in a first portion of a flexion range, and closed when the sole structure is dorsiflexed in a second portion of the flexion range that includes flex angles greater than in the first portion of the flexion range.

20 Claims, 10 Drawing Sheets

Related U.S. Application Data

(60) Provisional application No. 62/220,758, filed on Sep. 18, 2015, provisional application No. 62/220,638, filed on Sep. 18, 2015, provisional application No. 62/220,678, filed on Sep. 18, 2015, provisional application No. 62/220,633, filed on Sep. 18, 2015.

(51) Int. Cl.

| | |
|---|---|
| ***A43B 13/22*** | (2006.01) |
| ***A43B 23/02*** | (2006.01) |
| ***A43C 15/16*** | (2006.01) |
| *A43B 5/02* | (2006.01) |

(52) U.S. Cl.

CPC ..... *A43B 23/026* (2013.01); *A43B 23/028* (2013.01); *A43C 15/16* (2013.01); *A43B 5/02* (2013.01)

(56) References Cited

U.S. PATENT DOCUMENTS

| | | | | |
|---|---|---|---|---|
| 7,143,530 | B2 * | 12/2006 | Hudson | A43B 7/24 36/67 A |
| 7,685,747 | B1 * | 3/2010 | Gasparovic | A43B 11/00 36/102 |
| 8,225,534 | B2 * | 7/2012 | Mueller | A43B 5/12 36/76 R |
| 8,365,444 | B2 * | 2/2013 | Youngs | A43B 13/141 36/73 |
| 8,522,457 | B2 * | 9/2013 | Scholz | A43B 13/141 36/102 |
| 8,549,774 | B2 * | 10/2013 | Meschter | A43B 13/141 36/76 R |
| 8,763,275 | B2 * | 7/2014 | Shalom | A43B 3/246 36/102 |
| 8,991,072 | B2 * | 3/2015 | Peyton | A43B 21/28 36/35 B |
| 10,182,612 | B2 * | 1/2019 | Bunnell | A43B 5/02 |
| 10,398,198 | B2 * | 9/2019 | Orand | A43B 13/122 |
| 10,485,294 | B2 * | 11/2019 | Schneider | A43B 13/184 |
| 10,485,295 | B2 * | 11/2019 | Bunnell | A43B 23/042 |
| 10,575,585 | B2 * | 3/2020 | Kirk | A43B 13/141 |
| 10,660,400 | B2 * | 5/2020 | Baucom | A43B 13/141 |
| 2010/0186257 | A1 * | 7/2010 | Karl | A43B 5/12 36/44 |
| 2015/0173456 | A1 * | 6/2015 | Rushbrook | A43B 13/181 36/25 R |
| 2018/0042338 | A1 * | 2/2018 | Orand | A43B 13/186 |

FOREIGN PATENT DOCUMENTS

| | | | | |
|---|---|---|---|---|
| EP | 1074194 | A1 * | 2/2001 | A41D 19/01588 |
| GB | 2156652 | A * | 10/1985 | A43B 5/12 |

* cited by examiner

FOOTWEAR SOLE STRUCTURE WITH COMPRESSION GROOVES AND NONLINEAR BENDING STIFFNESS

CROSS-REFERENCE TO RELATED APPLICATIONS

This application is a divisional of U.S. patent application Ser. No. 15/266,664 filed Sep. 15, 2016, which claims the benefit of priority to U.S. Provisional Application No. 62/220,633 filed Sep. 18, 2015, and to U.S. Provisional Application No. 62/220,758 filed Sep. 18, 2015, and to U.S. Provisional Application No. 62/220,638 filed Sep. 18, 2015, and to U.S. Provisional Application No. 62/220,678 filed Sep. 18, 2015, each of which is hereby incorporated by reference in its entirety.

TECHNICAL FIELD

The present teachings generally include a sole structure for an article of footwear.

BACKGROUND

Footwear typically includes a sole structure configured to be located under a wearer's foot to space the foot away from the ground. Sole assemblies in athletic footwear are configured to provide desired cushioning, motion control, and resiliency.

DESCRIPTION

Figure 1:
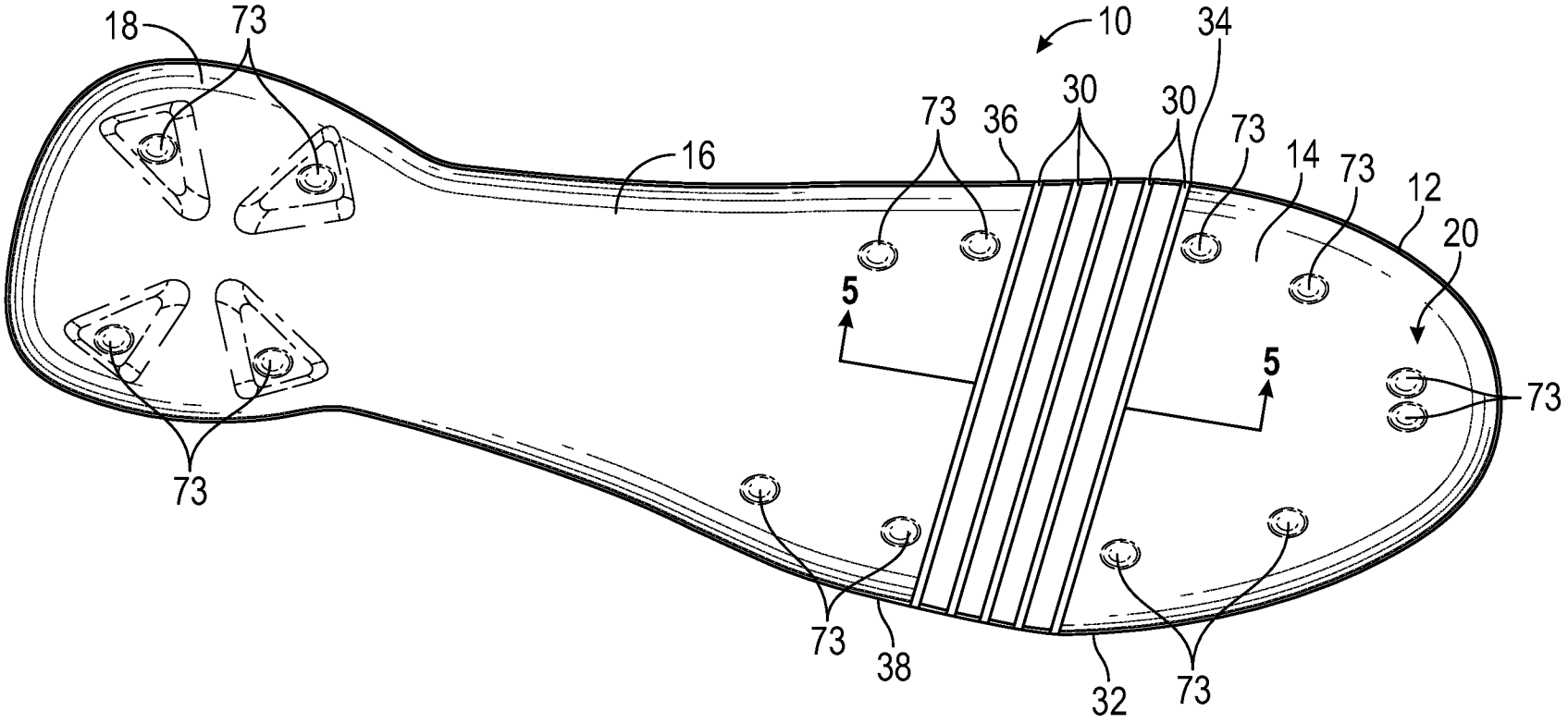
FIG. 1 is a schematic illustration in plan view of a sole structure for an article of footwear with a sole plate having grooves.

A sole structure for an article of footwear comprises a sole plate that has a forefoot portion with a foot-facing surface. The sole plate has at least one groove extending at least partially transversely in the foot-facing surface. The at least one groove is open when the sole structure is dorsiflexed in a first portion of a flexion range, and closed when the sole structure is dorsiflexed in a second portion of the flexion range that includes flex angles greater than in the first portion of the flexion range.

The first portion of the flexion range includes flex angles of the sole structure less than a first predetermined flex angle, and the second portion of the flexion range includes flex angles of the sole structure greater than or equal to the first predetermined flex angle. The sole structure has a change in bending stiffness at the first predetermined flex angle. In an embodiment, the first predetermined flex angle is an angle selected from the range of angles extending from 35 degrees to 65 degrees.

The sole plate has a resistance to deformation in response to compressive forces applied across the at least one groove when the at least one groove is closed. The sole plate has a base portion spaced apart from the foot-facing surface by the at least one groove. Tensile force at the base portion increases when the groove is closed and the sole plate compresses across the at least one groove.

Adjacent walls of the sole plate at the at least one groove contact one another at least at a distal portion of the at least one groove to close the at least one groove when the sole structure is dorsiflexed in the second portion of the flexion range. The sole plate thereby compressing across the distal portion of the at least one groove such that bending stiffness of the sole structure in the second portion of the flexion range is at least partially correlated with a compressive stiffness of the sole plate.

The at least one groove has at least a predetermined depth and width configured so that the at least one groove is open when the sole structure is dorsiflexed in the first portion of the flexion range. In an embodiment, the sole plate is chamfered or rounded at the at least one groove.

In an embodiment, the at least one groove has at least a predetermined depth and width such that adjacent walls of the sole plate at the at least one groove are nonparallel when the at least one groove is open and are parallel or at least closer to parallel when the at least one groove is closed. Optionally, a forward one of the adjacent walls inclines forward more than a rearward one of the adjacent walls when the at least one groove is open.

The at least one groove may extend from a lateral edge of the sole plate to a medial edge of the sole plate. The at least one groove may be straight along its length. The longitudinal axis of the at least one groove may be positioned at an angle relative to a longitudinal axis of the sole plate. For example, a lateral end of the at least one groove may be rearward of a medial end of the at least one groove. The at least one groove may be narrower at a base than at a distal end when the at least one groove is open.

In an embodiment, a resilient material may be disposed in the at least one groove such that the resilient material is compressed between adjacent walls of the sole plate at the at least one groove as the sole structure is dorsiflexed, a bending stiffness of the sole structure in the first portion of the flexion range thereby being at least partially determined by a compressive stiffness of the resilient material. For example, the resilient material may be polymeric foam.

In an embodiment, the sole plate further may further include a midfoot portion, or both a heel portion and a midfoot portion. A sole plate that has a forefoot portion, a midfoot portion, and a heel portion may be referred to as a full-length sole plate, as it is configured to extend under a full length of a foot.

In various embodiments, the sole plate may be a midsole, a portion of a midsole, an outsole, a portion of an outsole, an insole, a portion of an insole, a combination of an insole and a midsole, a combination of a midsole and an outsole, or a combination of an insole, a midsole, and an outsole. In an embodiment in which the sole plate is an outsole, a combination of a midsole and an outsole, or a combination of an insole, a midsole, and an outsole, the sole structure may further comprise traction elements that protrude at a ground-facing surface of the sole plate opposite from the foot-facing surface.

The sole plate may be various materials that provide desired properties such as a desired compressive stiffness and bending stiffness. For example, the sole plate may be any one or more of a thermoplastic elastomer, a glass composite, nylon including glass-filled nylons, spring steel, carbon fiber, ceramic or foam, or another material.

In an embodiment, a sole structure for an article of footwear comprises a sole plate that has a forefoot portion with a foot-facing surface. At least one groove is in the sole plate and extends lengthwise at least partially transversely across the foot-facing surface. The at least one groove is configured to be open when the forefoot portion of the sole structure is flexed in a longitudinal direction of the sole structure at flex angles less than a first predetermined flex angle, and closed when the forefoot portion of the sole structure is flexed in the longitudinal direction at flex angles greater than or equal to the first predetermined flex angle. The sole plate has a resistance to deformation in response to compressive forces applied across the at least one closed groove, and has a nonlinear bending stiffness with a change in bending stiffness at the first predetermined flex angle. The at least one groove may have at least a predetermined depth and width configured so that the at least one groove is open when the sole structure is dorsiflexed in the first portion of the flexion range. The at least one groove may have at least a predetermined depth and width such that adjacent walls of the sole plate at the at least one groove are nonparallel when the at least one groove is open, and are closer to parallel or parallel when the at least one groove is closed. A forward one of the adjacent walls may incline forward more than a rearward one of the adjacent walls when the at least one groove is open. A resilient material may be disposed in the at least one groove such that the resilient material is compressed between adjacent walls of the sole plate at the at least one groove as the sole structure is dorsiflexed, a bending stiffness of the sole structure in the first portion of the flexion range thereby being at least partially determined by a compressive stiffness of the resilient material. The resilient material may be, for example, polymeric foam.

The sole plate may be a midsole, a portion of a midsole, an outsole, a portion of an outsole, an insole, a portion of an insole, a combination of an insole and a midsole, a combination of a midsole and an outsole, or a combination of an insole, a midsole, and an outsole (i.e., a "unisole"). In any embodiment, the sole plate may further include a midfoot portion, or both a heel portion and a midfoot portion.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

Referring to the drawings, wherein like reference numbers refer to like components throughout the views, FIG. 1 shows a sole structure 10 for an article of footwear. The sole structure 10 may be for an article of footwear that is athletic footwear, such as football, soccer, or cross-training shoes, or the footwear may be for other activities, such as but not limited to other athletic activities. Embodiments of the footwear that include the sole structure 10 generally also include an upper, with the sole structure coupled to the upper. The sole structure 10 has a nonlinear bending stiffness that increases with increasing of the forefoot portion 14 in the longitudinal direction (i.e., dorsiflexion). As further explained herein, the sole structure 10 provides a change in bending stiffness when flexed in a longitudinal direction at one or more predetermined flex angles. More particularly, the sole structure 10 has a bending stiffness that is a piecewise function with changes at a first predetermined flex angle. The bending stiffness is tuned by the selection of various structural parameters discussed herein that determine the first predetermined flex angle. As used herein, "bending stiffness" and "bend stiffness" may be used interchangeably.

The sole structure 10 has a full-length, unitary sole plate 12 that has a forefoot portion 14, a midfoot portion 16, and a heel portion 18. The sole plate 12 provides a foot-facing surface 20 (also referred to herein as a foot-receiving surface, although the foot need not rest directly on the foot-receiving surface) that extends over the forefoot portion 14, the midfoot portion 16, and the heel portion 18.

The heel portion 18 generally includes portions of the sole plate 12 corresponding with rear portions of a human foot, including the calcaneus bone, when the human foot is supported on the sole structure 10 and is a size corresponding with the sole structure 10. The forefoot portion 14 generally includes portions of the sole plate 12 corresponding with the toes and the joints connecting the metatarsals with the phalanges of the human foot (interchangeably referred to herein as the "metatarsal-phalangeal joints" or "MPJ" joints). The midfoot portion 16 generally includes portions of the sole plate 12 corresponding with an arch area of the human foot, including the navicular joint. The forefoot portion, the midfoot portion, and the heel portion may also be referred to as a forefoot region, a midfoot region, and a heel region, respectively. As used herein, a lateral side of a component for an article of footwear, including a lateral edge 38 of the sole plate 12, is a side that corresponds with an outside area of the human foot (i.e., the side closer to the fifth toe of the wearer). The fifth toe is commonly referred to as the little toe. A medial side of a component for an article of footwear, including a medial edge 36 of the sole plate 12, is the side that corresponds with an inside area of the human foot (i.e., the side closer to the hallux of the foot of the wearer). The hallux is commonly referred to as the big toe.

The term "longitudinal," as used herein, refers to a direction extending along a length of the sole structure, i.e., extending from a forefoot portion to a heel portion of the sole structure. The term "transverse," as used herein, refers to a direction extending along a width of the sole structure, e.g., from a lateral side to a medial side of the sole structure. The term "forward" is used to refer to the general direction from the heel portion toward the forefoot portion, and the term "rearward" is used to refer to the opposite direction, i.e., the direction from the forefoot portion toward the heel portion. The term "anterior" is used to refer to a front or forward component or portion of a component. The term "posterior" is used to refer to a rear or rearward component of portion of a component. The term "plate" refers to a generally horizontally-disposed member generally used to provide structure and form rather than cushioning. A plate can be but is not necessarily flat and need not be a single component but instead can be multiple interconnected components. For example, a sole plate may be pre-formed with some amount of curvature and variations in thickness when molded or otherwise formed in order to provide a shaped footbed and/or increased thickness for reinforcement in desired areas. For example, the sole plate could have a curved or contoured geometry that may be similar to the lower contours of the foot.

Figure 3:
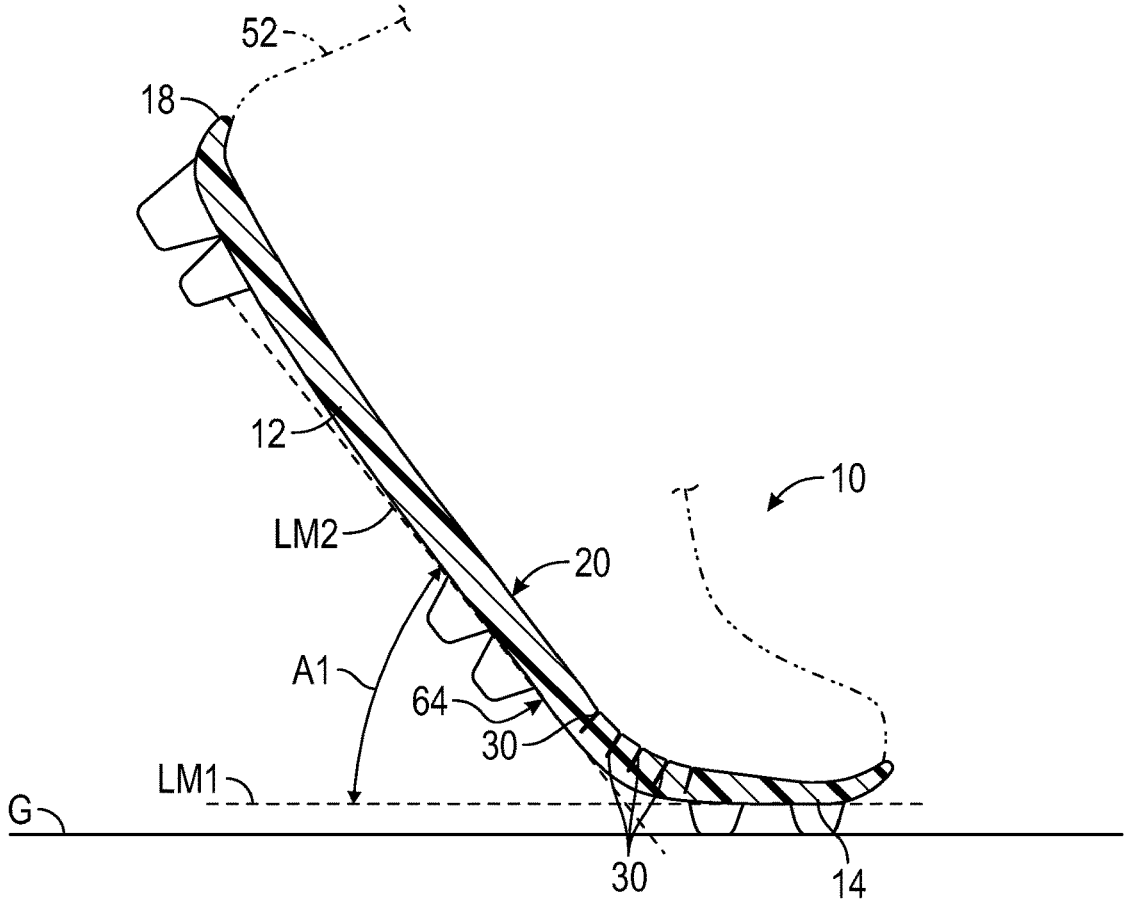
FIG. 3 is a schematic cross-sectional illustration in fragmentary side view of the sole structure of FIG. 1 flexed at a first predetermined flex angle with the grooves closed.

As shown in FIG. 3, a foot 52 can be supported by the foot-facing surface 20, with the foot above the foot-facing surface 20. The foot-facing surface 20 may be referred to as an upper surface of the sole plate 12. In the embodiment shown, the sole plate 12 is an outsole. In other embodiments, the sole plate may be an insole plate, also referred to as an inner board plate, an inner board, or an insole board. Still further, the sole plate could be a midsole plate or a unisole plate. Optionally, in the embodiment shown, an insole plate, or other layers may overlay the foot-facing surface 20 and be positioned between the foot 52 and the foot-facing surface 20.

Figure 6:
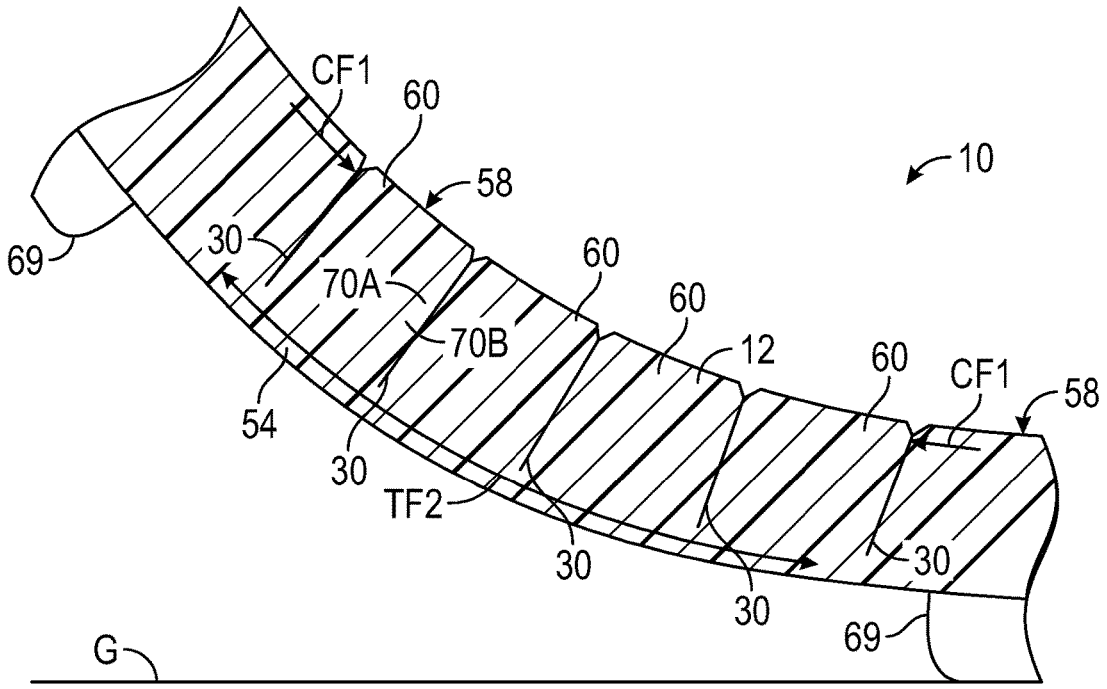
FIG. 6 is a schematic cross-sectional illustration in fragmentary view of the sole plate of FIGS. 1 and 3 with the grooves closed.

The sole plate 12 has at least one groove 30, and in the embodiment shown has a series of grooves 30, which also affect the bending stiffness of the sole structure 10. More specifically, the grooves 30 are configured to be open at flex angles less than a first predetermined flex angle A1 (indicated in FIGS. 3 and 4) and to be closed at flex angles greater than or equal to the first predetermined flex angle. With the grooves closed, compressive forces CF1 on the sole plate 12 are applied across the closed grooves 30, as shown in FIG. 6. The sole plate 12 at the closed grooves 30 has a resistance to deformation thus increasing the bending stiffness of the sole structure 10 when the grooves 30 close.

The first predetermined flex angle is defined as the angle formed at the intersection between a first axis LM1 and a second axis LM2 where the first axis generally extends along a longitudinal midline LM at a ground-facing surface 64 of sole plate 12 (best shown in FIG. 3) anterior to the grooves 30, and the second axis LM2 generally extends along the longitudinal midline LM at the ground-facing surface 64 of the sole plate 12 posterior to the grooves 30. The sole plate 12 is configured so that the intersection of the first and second axes LM1 and LM2 will typically be approximately centered both longitudinally and transversely below the grooves 30 discussed herein, and below the metatarsal-phalangeal joints of the foot 52 supported on the foot-facing surface 20. By way of non-limiting example, the first predetermined flex angle A1 may be from about 30 degrees)(° to about 65°. In one exemplary embodiment, the first predetermined flex angle A1 is found in the range of between about 30° and about 60°, with a typical value of about 55°. In another exemplary embodiment, the first predetermined flex angle A1 is found in the range of between about 15° and about 30°, with a typical value of about 25°. In another example, the first predetermined flex angle A1 is found in the range of between about 20° and about 40°, with a typical value of about 30°. In particular, the first predetermined flex angle can be any one of 35°, 36°, 37°, 38°, 39°, 40°, 41°, 42°, 43°, 44°, 45°, 46°, 47°, 48°, 49°, 50°, 51°, 52°, 53°, 54°, 55°, 56°, 57°, 58°, 59°, 60°, 61°, 62°, 63°, 64°, or 65°. Generally, the specific flex angle or range of angles at which a change in the rate of increase in bending stiffness occurs is dependent upon the specific activity for which the article of footwear is designed.

As the foot 52 flexes by lifting the heel portion 18 away from the ground G while maintaining contact with the ground G at a forward portion of the forefoot portion 14, it places torque on the sole structure 10 and causes the sole plate 12 to flex at the forefoot portion 14. The bending stiffness of the sole structure 10 during the first range of flex FR1 will be at least partially correlated with the bending stiffness of the sole plate 12, but without compressive forces across the open grooves 30.

As will be understood by those skilled in the art, during bending of the sole plate 12 as the foot 52 is flexed, there is a neutral axis of the in the sole plate 12 above which the sole plate 12 is in compression, and below which the sole plate 12 is in tension. The closing of the grooves 30 places additional compressive forces on the sole plate 12 above the neutral axis, thus effectively shifting the neutral axis of the sole plate 12 downward (toward the bottom surface) in comparison to a position of the neutral axis when the grooves 30 are open. The lower portion of the sole plate 12, including the bottom surface 64 is under tension, as indicated by tensile forces TF2 in FIG. 6.

Referring to FIG. 1, the grooves 30 extend along their lengths generally transversely in the sole plate 12 on the foot-facing surface 20. Each groove 30 is generally straight, and the grooves 30 are generally parallel to one another. The grooves 30 may be formed, for example, during molding of the sole plate 12. Alternatively, the grooves may be pressed, cut, or otherwise provided in the sole plate 12. Each groove 30 has a medial end 32 and a lateral end 34 (indicated with reference numbers on one of the grooves 30 in FIG. 1), with the medial end 32 closer to a medial edge 36 of the sole plate 12, and the lateral end 34 closer to a lateral edge 38 of the sole plate 12. The lateral end 34 is slightly rearward of the medial end 32 so that the grooves 30 fall under and generally follow the anatomy of the metatarsal phalangeal joints of the foot 52. The grooves 30 extend generally transversely in the sole plate 12 from the medial edge 36 to the lateral edge 38.

Figure 14:
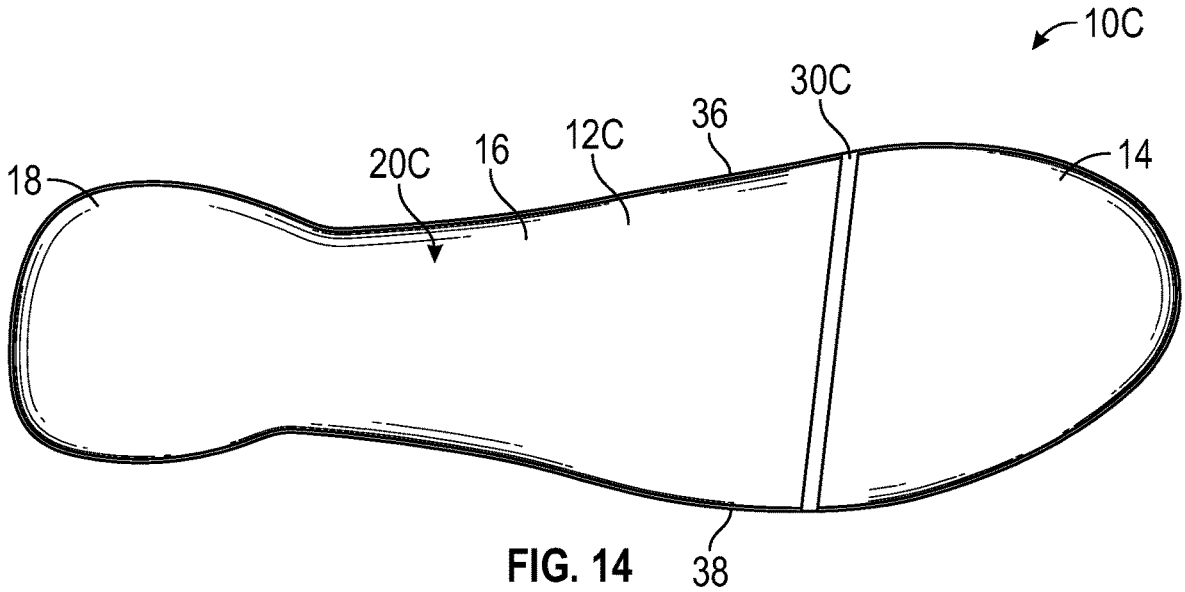
FIG. 14 is a schematic illustration in plan view of an alternative sole structure for an article of footwear with an alternative sole plate in accordance with the present teachings.

The number of grooves 30 can be only one (i.e., a single groove as shown by groove 30C in the embodiment of FIG. 14), or there may be multiple grooves 30 (e.g., a series of grooves). Generally, the width and depth of the grooves 30 will depend upon the number of grooves 30 that extend generally transversely in the forefoot region, and will be selected so that the one or more grooves close at the first predetermined flex angle described herein. In various embodiments having more than one groove 30, the grooves could have different depths, widths, and or spacing from one another, and could have different angles (i.e., adjacent walls of the sole plate 12 at different grooves could be at different relative angles). For example, grooves toward the middle of the series of grooves in the longitudinal direction could be wider than grooves toward the anterior and posterior ends of the series of grooves. Generally, the overall width of the one or more grooves (i.e., from the anterior end to the posterior end of the series of grooves) is selected to be sufficient to accommodate a range of positions of a wearer's metatarsal phalangeal joints based on population averages for the particular size of footwear. If only one groove is provided, it will generally have a greater width than if multiple grooves 30 are provided in order to close when the sole plate is at the same predetermined flex angle, as illustrated by the wider groove 30C of FIG. 14.

In other embodiments, two or more sets of series of grooves can be spaced transversely apart from one another (e.g., with one set on a medial side of the longitudinal midline LM, extending from the medial edge 36 and terminating before the longitudinal midline LM, and the other set on a lateral side of the longitudinal midline LM, extending from the lateral edge 38 and terminating before the longitudinal midline LM). Similarly, three or more sets can be positioned transversely and spaced apart from one another. In such embodiments with multiple sets of transversely spaced grooves, the sole plate may have a recess or aperture between the sets of grooves so that the material of the sole plate does not interfere with closing of the grooves. The grooves 30 do not extend completely through the sole plate 12, as is apparent in FIGS. 3, 5 and 6.

Although not shown in the embodiment of FIG. 1, the sole plate 12 may include a first notch in the medial edge 36 of the sole plate 12, and a second notch in the lateral edge 38 of the sole plate, with the first and second notches generally aligned with the series of grooves 30 but not necessarily parallel with the grooves 30. In other words, a line connecting the notches would pass through the series of grooves 30. The notches increase flexibility of the sole plate 12 in the area of the forefoot portion 14 where the grooves 30 are located.

Figure 5:
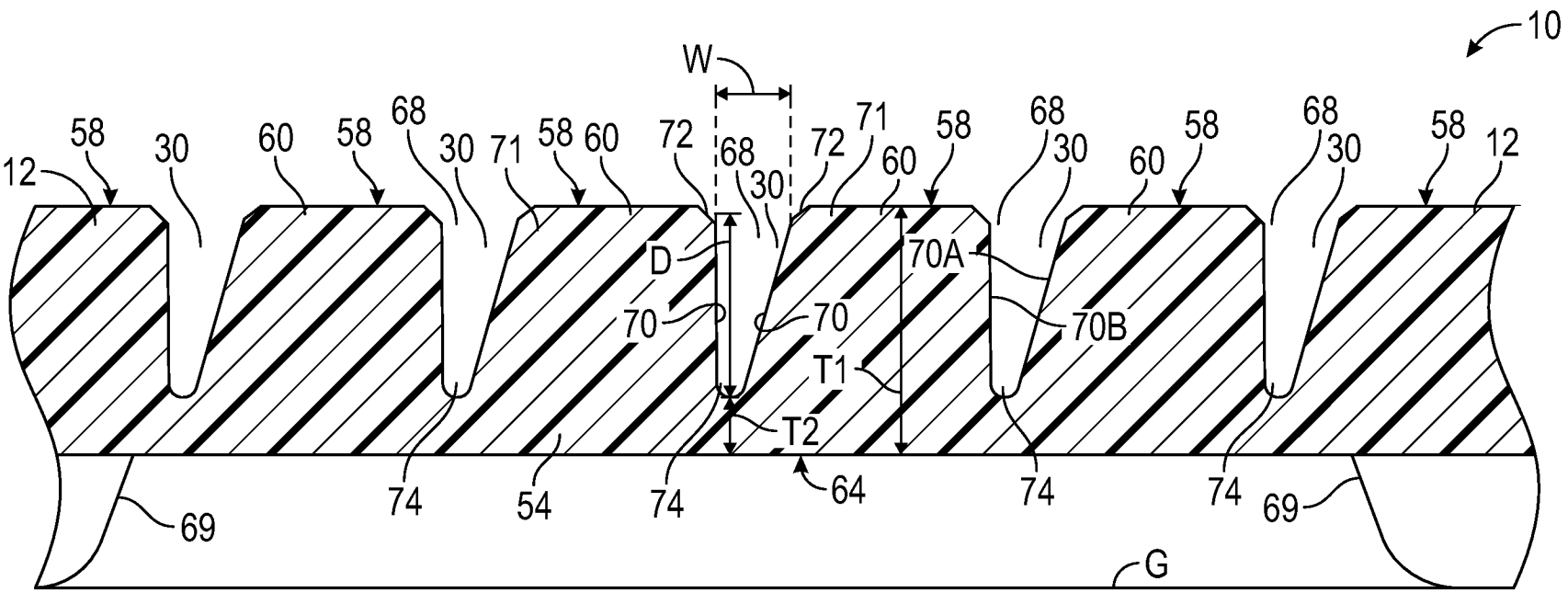
FIG. 5 is a schematic cross-sectional illustration in fragmentary view of the sole plate of FIG. 1 taken at lines 5-5 in FIG. 1 with the grooves open.

Referring to FIG. 5, the grooves 30 in the sole plate 12 create transversely-extending ribs 60 adjacent each groove 30. The ribs 60 are the material of the sole plate between the adjacent grooves. Each groove 30 has a predetermined depth D from the surface 58 of the sole plate to a base portion 54 of the sole plate 12 below the groove 30. The surface 58 is a portion of the foot-facing surface 20 adjacent the grooves 30. In other embodiments, different ones of the grooves 30 may have different depths, each at least the predetermined depth D. The depth D is less than the thickness T1 of the sole plate 12 from the surface 58 to a ground-facing surface 64 of the sole plate 12. The difference between the thickness T1 and the depth D is the thickness T2 of the base portion 54.

Figure 2:
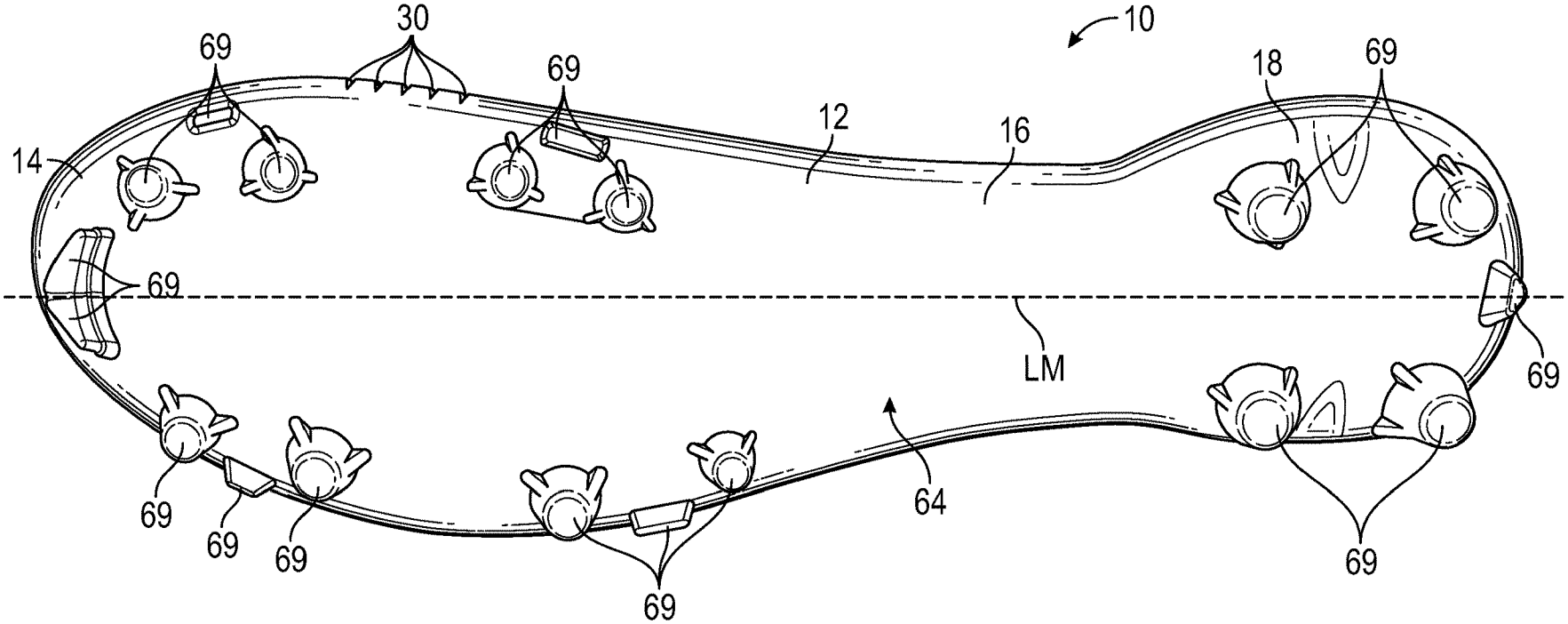
FIG. 2 is a schematic illustration in perspective view showing a bottom of the sole plate of FIG. 1.

As best shown in FIG. 2, the sole plate 12 has traction elements 69 that protrude further from the ground-facing surface 64 than the base portion 54 of the sole plate 12 at the series of grooves 30, thus ensuring that the ground-facing surface 64 at the base portion of the sole plate 12 at the series of grooves 30 is either removed from ground-contact (i.e., lifted above the ground G) or at least bears less load. Ground reaction forces on the base portion 54 that could lessen flexibility of the base portion 54 and affect opening and closing of the grooves 30 are thus reduced. The traction elements 69 may be integrally formed as part of the sole plate 12 or may be attached to the sole plate 12. In the embodiment shown, the traction elements 69 are integrally formed cleats. For example, as best shown in FIG. 1, the sole plate 12 has dimples 73 on the foot-facing surface 20 where the traction elements 69 extend downward. In other embodiments, the traction elements may be, for example, removable spikes.

Referring to FIG. 5, each groove 30 has a predetermined width W at a distal end 68 of the groove 30, remote from the base portion 54. Distal ends 71 of the ribs 60 may be rounded or chamfered at each groove 30, as indicated in FIG. 5 by chamfer 72. When the grooves 30 close, the chamfered or rounded distal ends 71 reduce the possibility of plastic deformation of the ribs 60, as could occur if the distal ends 71 had sharp corners when compressive forces are applied across the closed grooves 30 at adjacent ribs 60. The width W is measured between adjacent walls 70 of adjacent ribs 60 at the start of any chamfer (i.e., at the point on the wall 70 just below any chamfered or rounded edge). The walls 70 are also referred to herein as side walls, although they extend transversely and are forward and rearward of each groove 30. Each of the grooves 30 is narrower at a base 74 of the groove 30 (also referred to as a root of the groove 30, just above the base portion 54) than at the distal end 68 (which is at the widest portion of the groove 30 closest to the surface 58 (the portion of the foot-facing surface 20 at the grooves 30) when the grooves 30 are open. Although each groove 30 is depicted as having the same width W, different ones of the grooves 30 could have different widths.

Optionally, the predetermined depth D and predetermined width W can be tuned (i.e., selected) so that adjacent side walls 70 (i.e. a front wall 70A and a rear wall 70B at each groove 30) are nonparallel when the grooves 30 are open, as shown in FIG. 5. The adjacent walls 70A, 70B are parallel when the grooves 30 are closed (or are at least closer to parallel that when the grooves 30 are open), as shown in FIG. 6. By configuring the sole plate 12 so that the walls 70A, 70B are nonparallel in the open position, surface area contact of the walls 70 is maximized when the grooves 30 are closed, such as when the walls 70 are parallel when closed, such as when the walls 70 are parallel when closed. In such an embodiment, the entire planar portions of the walls 70 below the chamfers 72 and above the base 74 can simultaneously come into contact when the grooves 30 close. In contrast, if the adjacent walls 70A, 70B were parallel when the grooves 30 were open, then the walls 70 would be non-parallel at least when the grooves 30 initially close, potentially resulting in a reduced contact area of the adjacent walls and/or stress concentrations.

Optionally, the grooves 30 can be configured so that forward walls 70A at each of the grooves 30 incline forward (i.e., toward the front of the sole plate 12 in the longitudinal direction) more than rearward walls 70B at each of the grooves 30 when the grooves 30 are open and the sole plate 12 is in an unflexed position as shown in FIG. 5. The unflexed position is the position of the sole plate 12 when the heel portion 18 is not lifted and traction elements 69 at both the forefoot portion 14 and the heel portion 18 are in contact with the ground G. In the unflexed, relaxed state of the sole plate 12, the sole plate 12 may have a flex angle of zero degrees. The relative inclinations of the walls 70A, 70B affects when the grooves 30 close (i.e., at which flex angle the grooves 30 close). Inclining the forward walls 70A more than the rearward walls 70B ensures that the grooves 30 close at a greater first predetermined flex angle A1 than if the rearward side wall 70B inclined forward more than the forward side wall 70A.

FIG. 5 shows the grooves 30 in an open position. The grooves 30 are configured to be open when the sole structure 10 is dorsiflexed in the longitudinal direction at flex angles less than the first predetermined flex angle A1 shown in FIG. 4. Stated differently, the grooves 30 are configured to be open during the first range of flex FR1. The grooves 30 are configured to close when the sole structure 10 is dorsiflexed in the longitudinal direction at flex angles greater than or equal to the first predetermined flex angle A1 (i.e., in a second range of flexion FR2). When the grooves 30 close, the sole plate 12 has a resistance to deformation in response to compressive forces across the closed grooves 30 so that the sole structure 10 has a change in bending stiffness at the first predetermined flex angle A1. FIG. 6 shows the walls 70 in contact, and the resulting compressive forces CF1 at the distal ends 71 (labeled in FIG. 5) of the ribs 60 near at least the distal ends 68 (labeled in FIG. 5) of the closed grooves 30, and increased tensile forces TF2 at the base portion 54. The closed grooves 30 provide resistance to the compressive forces CF1, which may elastically deform the ribs 60.

Figure 4:
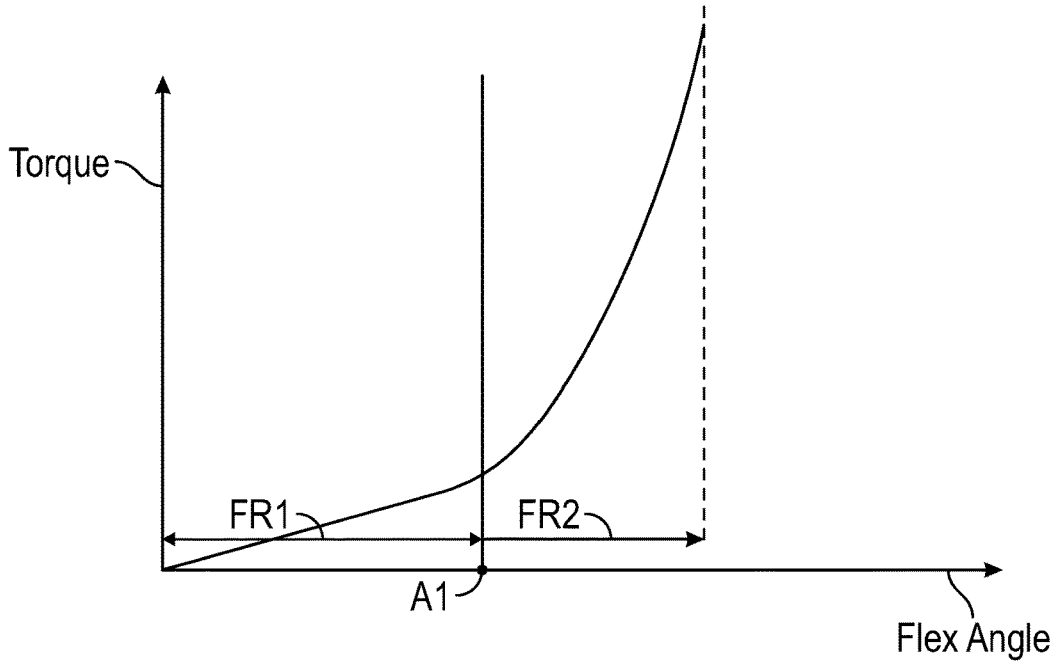
FIG. 4 is a plot of torque versus flex angle for the sole structure of FIGS. 1-3.

FIG. 4 shows an example plot of torque (in Newton-meters) on the vertical axis and flex angle (in degrees) on the horizontal axis. The torque is applied to the heel region 18 when the sole plate 12 is dorsiflexed. The plot of FIG. 4 indicates the bending stiffness (slope of the plot) of the sole structure 10 in dorsiflexion. As is understood by those skilled in the art, the torque results from a force applied at a distance from a bending axis located in the proximity of the metatarsal phalangeal joints, as occurs when a wearer dorsiflexes the sole structure 10. The bending stiffness changes (increases) at the first predetermined flex angle A1. The bending stiffness is a piecewise function. In the first range of flexion FR1, the bending stiffness is a function of the bending stiffness of the sole plate 12 without compressive forces across the open grooves 30, as the open grooves 30 cannot bear forces. In the second range of flexion FR2, the bending stiffness is at least in part a function of the compressive stiffness of the sole plate 12 under compressive loading of the sole plate 12 across a distal portion of the closed grooves 30 (i.e., a portion closest to the foot-facing surface 20 and the foot 52).

As an ordinarily skilled artisan will recognize in view of the present disclosure, a sole plate 12 will bend in dorsiflexion in response to forces applied by corresponding bending of a user's foot at the MPJ during physical activity. Throughout the first portion of the flexion range FR1, the bending stiffness (defined as the change in moment as a function of the change in flex angle) will remain approximately the same as bending progresses through increasing angles of flexion. Because bending within the first portion of the flexion range FR1 is primarily governed by inherent material properties of the materials of the sole plate 12, a graph of torque (or moment) on the plate versus angle of flexion (the slope of which is the bending stiffness) in the first portion of the flexion range FR1 will typically demonstrate a smoothly but relatively gradually inclining curve (referred to herein as a "linear" region with constant bending stiffness). At the boundary between the first and second portions of the range of flexion, however, the grooves 30 close, such that additional material and mechanical properties exert a notable increase in resistance to further dorsiflexion. Therefore, a corresponding graph of torque versus angle of flexion (the slope of which is the bending stiffness) that also includes the second portion of the flexion range FR2 would show—beginning at an angle of flexion approximately corresponding to angle A1—a departure from the gradually and smoothly inclining curve characteristic of the first portion of the flexion range FR1. This departure is referred to herein as a "nonlinear" increase in bending stiffness, and would manifest as either or both of a stepwise increase in bending stiffness and/or a change in the rate of increase in the bending stiffness. The change in rate can be either abrupt, or it can manifest over a short range of increase in the bend angle (i.e., also referred to as the flex angle or angle of flexion) of the sole plate 12. In either case, a mathematical function describing a bending stiffness in the second portion of the flexion range FR2 will differ from a mathematical function describing bending stiffness in the first portion of the flexion range.

As will be understood by those skilled in the art, during bending of the sole plate 12 as the foot is dorsiflexed, there is a layer in the sole plate 12 referred to as a neutral plane (although not necessarily planar) or neutral axis above which the sole plate 12 is in compression, and below which the sole plate 12 is in tension. The closing of the grooves 30 places additional compressive forces on the sole plate 12 above the neutral plane, and additional tensile forces below the neutral plane, nearer the ground-facing surface. In addition to the mechanical (e.g., tensile, compression, etc.) properties of the sole plate 12, structural factors that likewise affect changes in bending stiffness during dorsiflexion include but are not limited to the thicknesses, the longitudinal lengths, and the medial-lateral widths of different portions of the sole plate 12.

Figure 7:
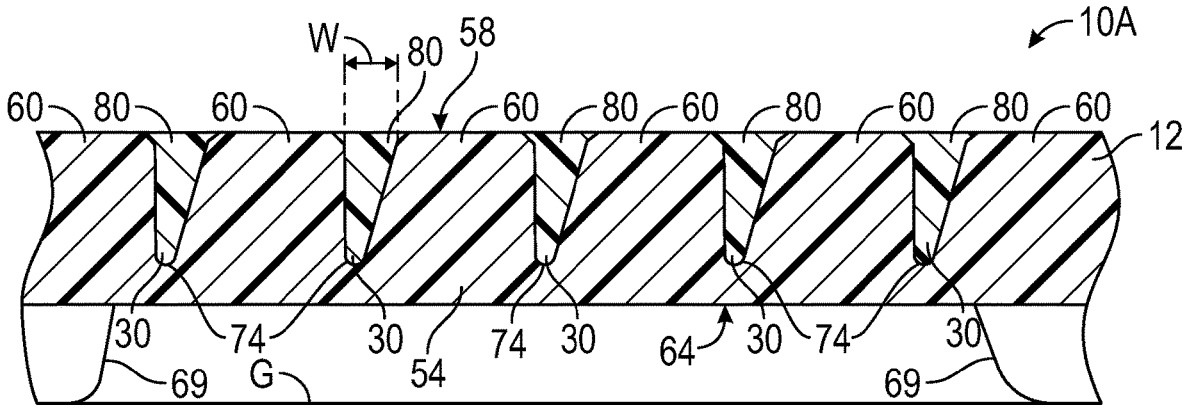
FIG. 7 is a schematic cross-sectional illustration in fragmentary side view of an alternative embodiment of a sole structure in accordance with the present teachings.
Figure 8:
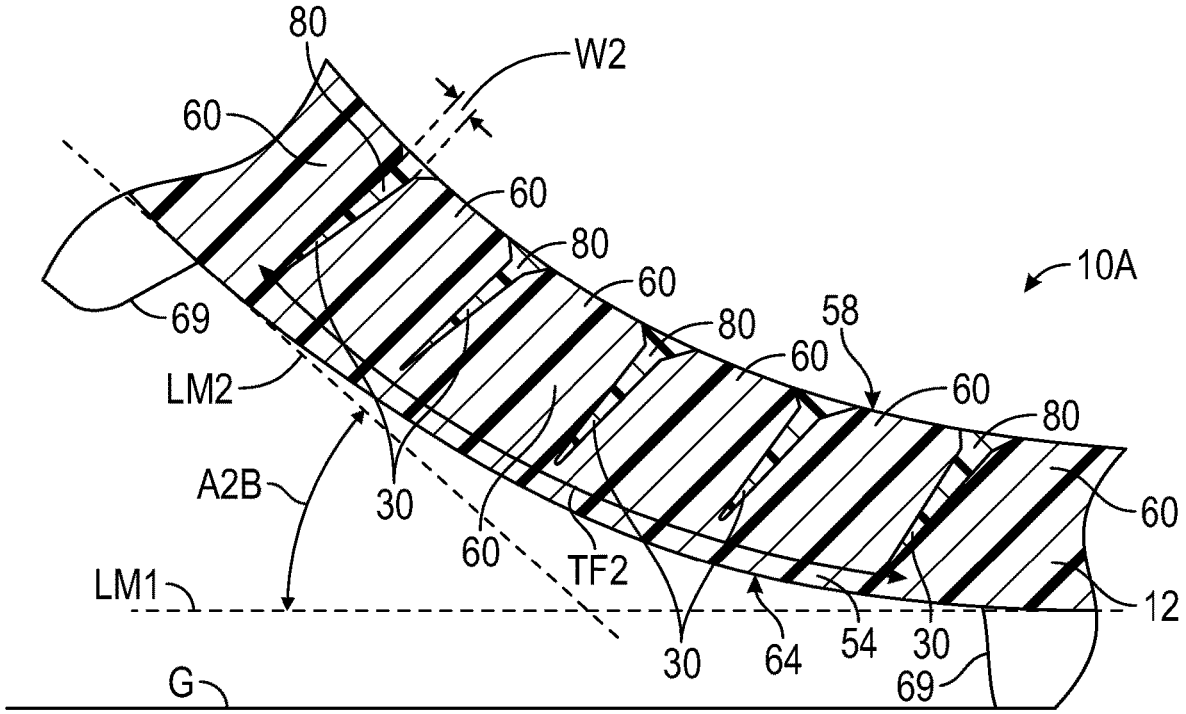
FIG. 8 is a schematic cross-sectional illustration in fragmentary side view of the sole structure of FIG. 7 in a flexed position with the grooves closed.
Figure 9:
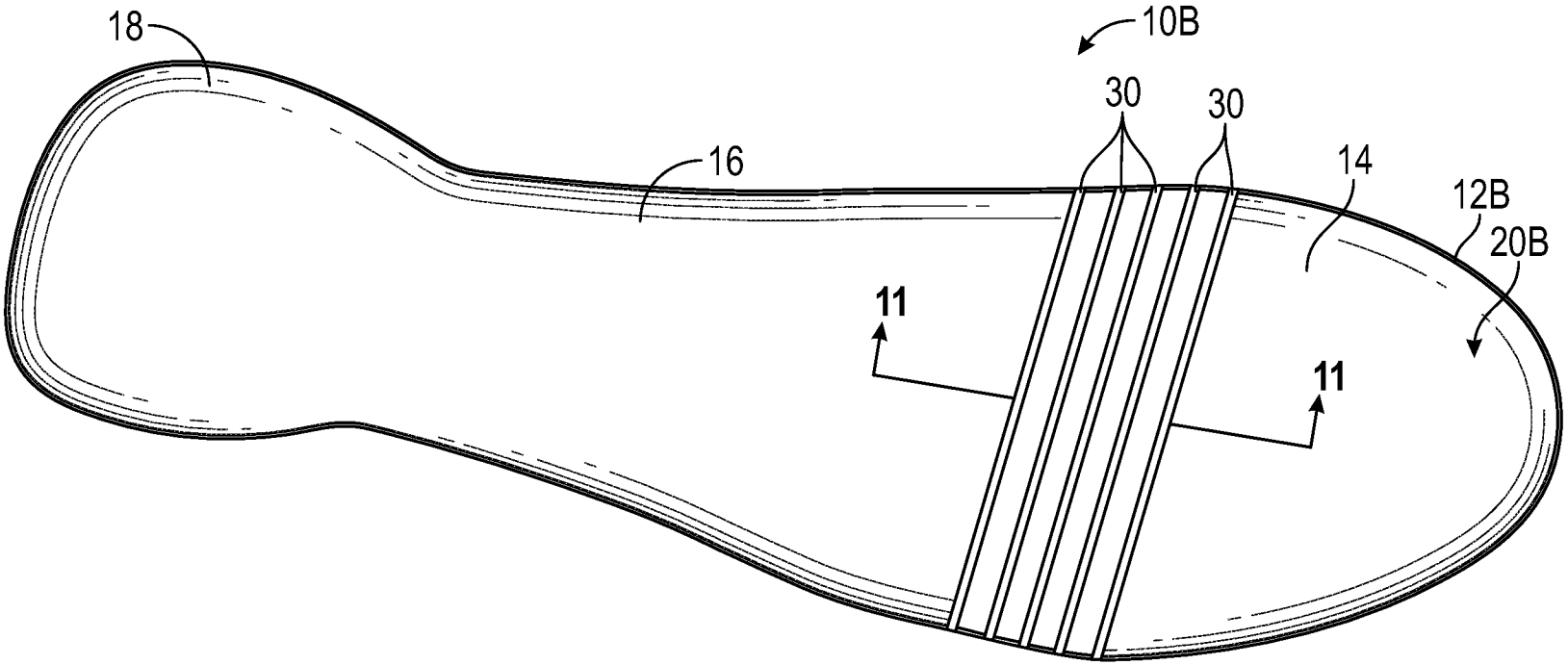
FIG. 9 is a schematic illustration in plan view of an alternative sole structure for an article of footwear with an alternative sole plate having grooves in accordance with the present teachings.
Figure 10:
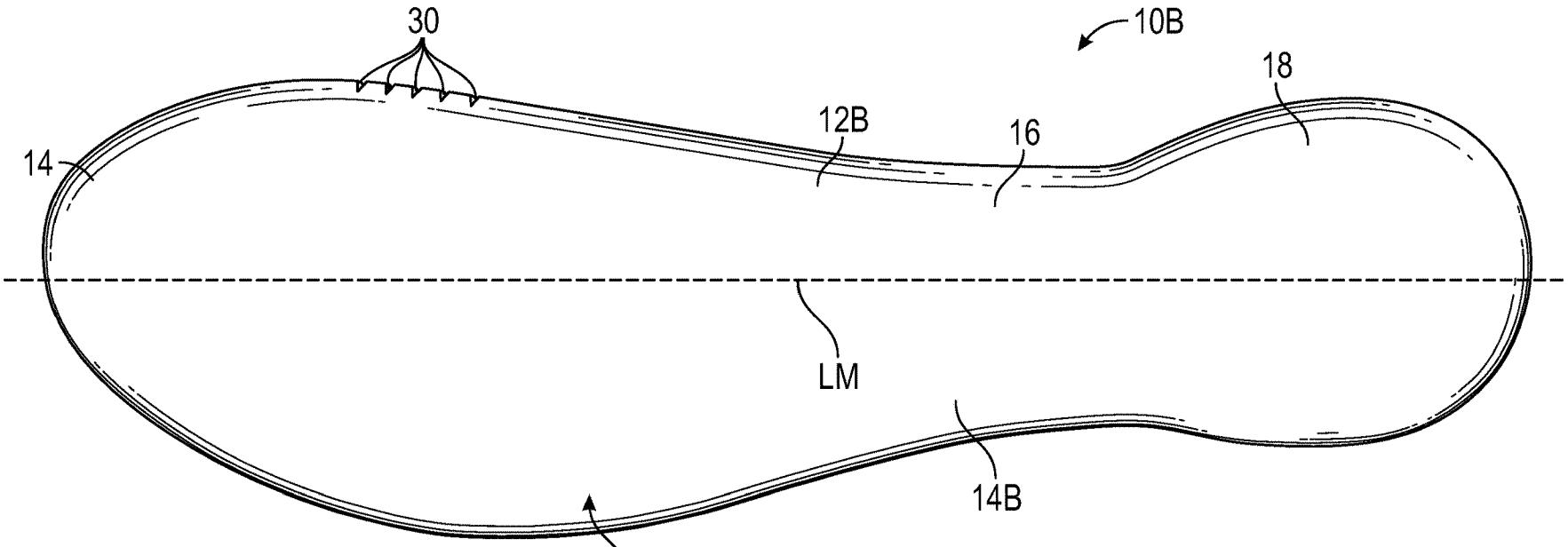
FIG. 10 is a schematic illustration in perspective view showing a bottom of the sole plate of FIG. 9.
Figure 11:
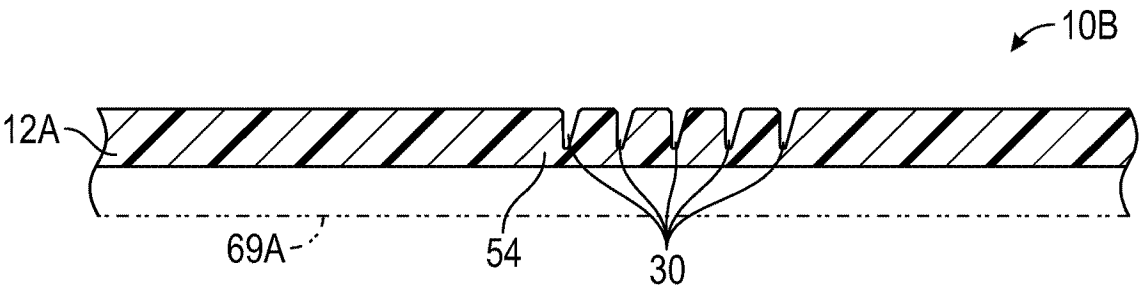
FIG. 11 is a schematic cross-sectional illustration in fragmentary view of the sole plate of FIG. 9 taken at lines 11-11 in FIG. 9 with the grooves open.

FIGS. 7 and 8 show a portion of an alternative embodiment of a sole structure 10A in which a resilient material 80 is disposed in the grooves 30 of the sole plate 12. In the embodiment shown, for purposes of illustration, the resilient material 80 is disposed in each of the grooves 30 of the sole plate 12. Optionally, the resilient material 80 can be disposed in only some of the grooves 30, or in only one of the grooves 30. The resilient material 80 may be a resilient (i.e., reversibly compressible) polymeric foam, such as an ethylene vinyl acetate (EVA) foam or a thermoplastic polyurethane (TPU) foam selected with a compression strength and density that provides a compressive stiffness different than (i.e., less than or greater than) the compressive stiffness of the materials of the sole plate 12.

In FIG. 7, the sole structure 10A is shown in a relaxed, unflexed state having a flex angle of 0 degrees. The grooves 30 are in the open position in FIG. 7, although they are filled with the resilient material 80. In the embodiment shown, the sole plate 12 is configured to have a greater compressive stiffness (i.e., resistance to deformation in response to compressive forces) than the resilient material 80. Accordingly, when the flex angle increases during dorsiflexion, the resilient material 80 will begin being compressed by the sole plate 12 during bending of the sole structure 10A as the sole plate 12 flexes (i.e., bends) until the resilient material 80 reaches a maximum compressed position at a first predetermined flex angle A2B shown in FIG. 8. At the maximum compressed position of the resilient material 80, the grooves 30 are in a closed position as the adjacent walls of each groove cannot move any closer together. The resilient material 80 therefore increases the bending stiffness of the sole structure 10A at flex angles less than a flex angle at which the grooves 30 reach the closed position (i.e., the first predetermined flex angle A2B) in comparison to embodiments in which the grooves 30 are empty as more torque is required to flex the sole plate 12 with the resilient material 80 in the groove. The bending stiffness of the sole structure 10A is therefore at least partially determined by a compressive stiffness of the resilient material 80 at flex angles less than the first predetermined flex angle A2B. When the grooves 30 of the sole structure 10A are closed, adjacent walls of the sole plate 12 at each groove 30 do not contact one another and are not parallel, but are closer to one another than when the grooves 30 are open. In other words, the closed grooves 30 of an embodiment with resilient material 80 in the grooves 30 have a width W2 less than the width W of the open grooves 30. Resilient material 80 can be similarly disposed in any or all of the grooves of any of the alternative sole structures 10B, 10C disclosed herein.

FIGS. 9-12 show an alternative embodiment of a sole structure 10B. The sole structure 10B is alike in all aspects to the sole structure 10 of FIG. 1, except that the sole structure 10B has a sole plate 12B that has no traction elements 69. Instead, a foot-facing surface 20B of the sole plate 12B is without dimples 73, and may be substantially flat or may be contoured to a shape of the lower contours of the foot. A bottom surface 64B of the sole plate 12B may be substantially flat and without traction elements 69. For example, the sole plate 12B is referred to as substantially flat, although both the foot-facing surface 20B and the bottom surface 64B may be pre-formed with a slight amount of curvature and variations in thickness when molded or otherwise formed in order to provide a shaped footbed and/or increased thickness for reinforcement in desired areas.

Figure 12:
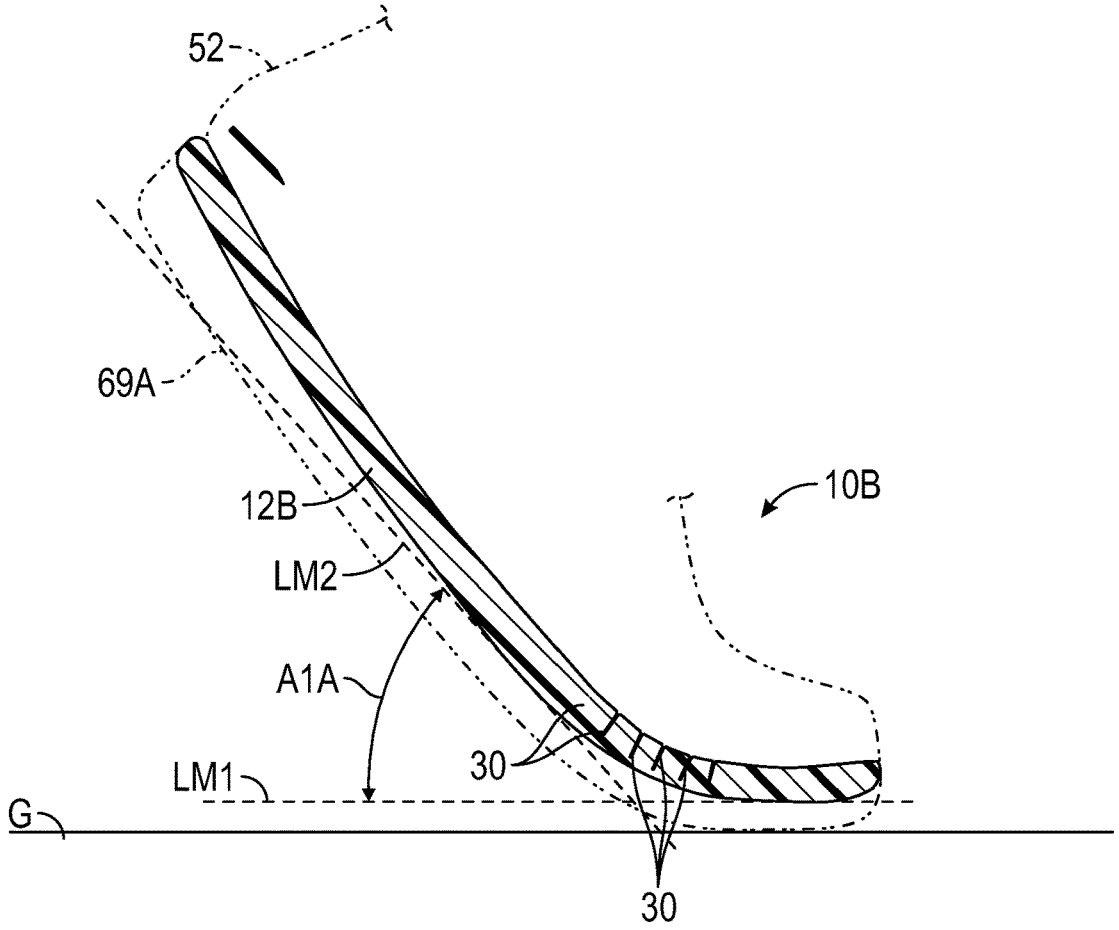
FIG. 12 is a schematic cross-sectional illustration in fragmentary side view of the sole structure of FIG. 9 flexed at a first predetermined flex angle.
Figure 13:
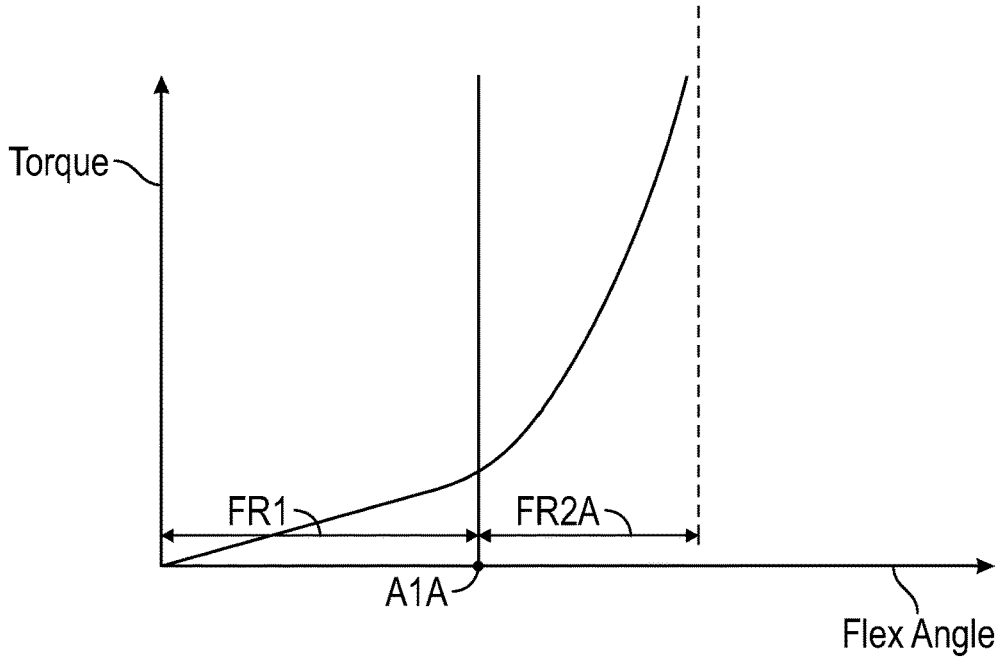
FIG. 13 is a plot of torque versus flex angle for the sole structure of FIGS. 9-12.

In the embodiment shown, the sole plate 12B is an insole plate, also referred to as an inner board or insole board. As shown in FIG. 12, a separate outsole 69A (represented in phantom) is secured to and positioned beneath the sole plate 12B. Similarly to the sole plate 10, the grooves 30 are open when the sole plate 12B is at flex angles less than a first predetermined flex angle indicated as flex angle A1A in FIG. 12 (i.e., in a first range of flexion FR1 shown in FIG. 13). The grooves 30 close when the sole plate 12B is flexed at a flex angle greater than or equal to the first predetermined flex angle A1A (i.e., in a second range of flexion FR2A shown in FIG. 13), as shown by the closed grooves 30 in FIG. 12. A first bending stiffness in the first range of flexion FR1 increases to a second bending stiffness in the second range of flexion, with a change in bending stiffness at the first predetermined flex angle A1A due to the closed grooves 30.

Figure 15:
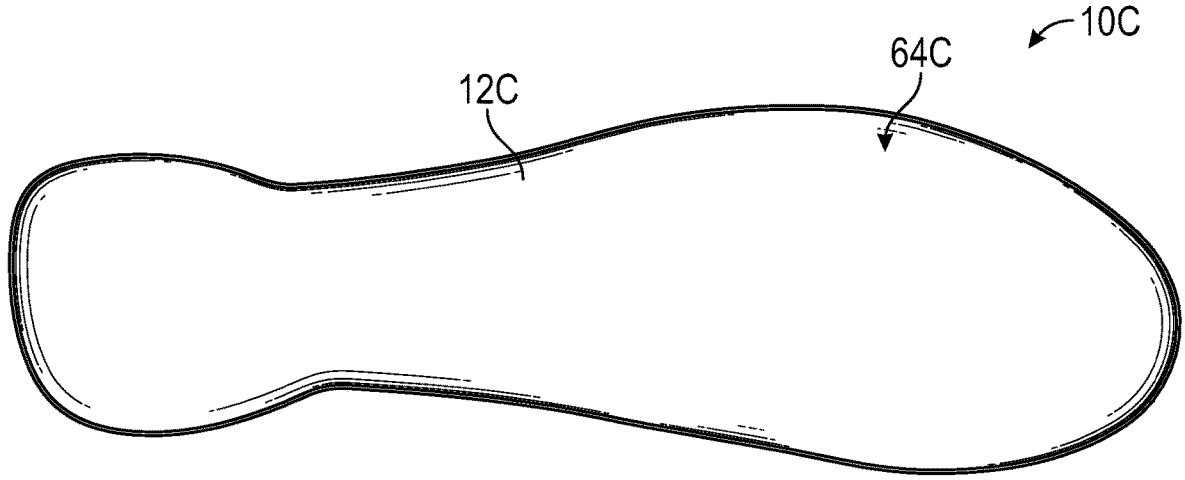
FIG. 15 is a schematic illustration in bottom view of the sole plate of FIG. 14.

FIGS. 14 and 15 show an alternative embodiment of a sole structure 10C. The sole structure 10C is alike in all aspects to the sole structure 10B of FIGS. 9-12, except that the sole structure 10C has a sole plate 12C that has only one groove 30C extending from the medial edge 36 to the lateral edge 38 in the forefoot portion 14. The sole structure 10C is configured so that the groove 30C is positioned under a wearer's metatarsal phalangeal joints (i.e., of the foot 52) based on population averages for the particular size of footwear. As discussed herein, the groove 30C is wider than each groove 30 of FIG. 1 so that the groove 30C will close at a first predetermined flex angle with a numerical value equal to or similar to that of the grooves 30.

Various materials can be used for the sole plates 12, 12B, and 12C. For example, a thermoplastic elastomer, such as thermoplastic polyurethane (TPU), a glass composite, a nylon including glass-filled nylons, a spring steel, carbon fiber, ceramic or a dense foam may be used for the respective sole plate 12, 12B, or 12C.

The sole structures 10, 10A, 10B, and 10C may also be referred to as sole assemblies, especially when the corresponding sole plates 12, 12B and 12C are assembled with other sole components in the sole structures, such as with other sole layers. For example, the sole plate 12B assembled with the outsole 69A is a sole assembly.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A sole structure for an article of footwear comprising:

a unitary, one-piece sole plate having a forefoot portion with a foot-facing surface and a ground-facing surface;

wherein the unitary, one-piece sole plate includes integral traction elements protruding at the ground-facing surface of the unitary, one-piece sole plate;

wherein the unitary, one-piece sole plate has at least one groove extending at least partially transversely in the foot-facing surface and has a base portion below the at least one groove;

wherein the at least one groove includes a series of grooves that have at least one of different depths, different widths in a longitudinal direction of the unitary, one piece sole plate, or different spacing from one another;

wherein the traction elements are forward of and rearward of the at least one groove and protrude further from the ground-facing surface than the base portion of the unitary, one-piece sole plate;

wherein the at least one groove is open when the sole structure is dorsiflexed in a first portion of a flexion range, and closed when the sole structure is dorsiflexed in a second portion of the flexion range that includes flex angles greater than in the first portion of the flexion range;

wherein the base portion extends under the at least one groove, between the at least one groove and the ground-facing surface, and spaced apart from the foot-facing surface by the at least one groove; and tensile force at the base portion increases when the at least one groove is closed and the unitary, one-piece sole plate compresses across the at least one groove.

2. The sole structure of claim 1, wherein the ground-facing surface at the base portion is free of any of the traction elements.

3. The sole structure of claim 2, wherein:

the at least one groove includes multiple grooves extending from a lateral edge to a medial edge of the unitary, one-piece sole plate;

the traction elements forward of the at least one groove include a forward lateral traction element adjacent the lateral edge and a forward medial traction element adjacent the medial edge; and both the forward lateral traction element and the forward medial traction element border a forward-most one of the multiple grooves and no other ones of the traction elements border the forward-most one of the multiple grooves.

4. The sole structure of claim 2, wherein:

the at least one groove includes multiple grooves extending from a lateral edge to a medial edge of the unitary, one-piece sole plate;

the traction elements rearward of the at least one groove include a rearward lateral traction element adjacent the lateral edge and a rearward medial traction element adjacent the medial edge; and both the rearward lateral traction element and the rearward medial traction element border a rearward-most one of the multiple grooves and no other ones of the traction elements border the rearward-most one of the multiple grooves.

5. The sole structure of claim 1, wherein each of the traction elements is disposed adjacent to a perimeter of the unitary, one-piece sole plate.

6. The sole structure of claim 1, wherein the at least one groove extends from a lateral edge of the unitary, one-piece sole plate to a medial edge of the unitary, one-piece sole plate.

7. The sole structure of claim 6, wherein:

the unitary, one-piece sole plate has a first notch in the medial edge and a second notch in the lateral edge; and the first notch and the second notch are aligned with the at least one groove.

8. The sole structure of claim 1, wherein:

the first portion of the flexion range includes flex angles of the sole structure less than a first predetermined flex angle, and the second portion of the flexion range includes flex angles of the sole structure greater than or equal to the first predetermined flex angle; and the sole structure has a nonlinear bending stiffness with a change in bending stiffness at the first predetermined flex angle.

9. The sole structure of claim 8, wherein the first predetermined flex angle is an angle selected from the range of angles extending from 35 degrees to 65 degrees.

10. The sole structure of claim 1, wherein the at least one groove has at least a predetermined depth and width such that adjacent walls of the unitary, one-piece sole plate at the at least one groove are nonparallel when the at least one groove is open and are closer to parallel or parallel when the at least one groove is closed.

11. The sole structure of claim 10, wherein a forward one of the adjacent walls inclines forward more than a rearward one of the adjacent walls when the at least one groove is open.

12. The sole structure of claim 1, wherein the at least one groove is straight.

13. The sole structure of claim 1, wherein the at least one groove has a medial end and a lateral end, with the lateral end rearward of the medial end.

14. The sole structure of claim 1, wherein the at least one groove is narrower at a base of the at least one groove than at a distal end of the at least one groove when the at least one groove is open.

15. The sole structure of claim 1, wherein adjacent walls of the unitary, one-piece sole plate at the at least one groove contact one another at least at a distal portion of the at least one groove to close the at least one groove when the sole structure is dorsiflexed in the second portion of the flexion range.

16. The sole structure of claim 1, further comprising:

a resilient material disposed in the at least one groove such that the resilient material is compressed between adjacent walls of the unitary, one-piece sole plate at the at least one groove as the sole structure is dorsiflexed, a bending stiffness of the sole structure in the first portion of the flexion range thereby being at least partially determined by a compressive stiffness of the resilient material.

17. The sole structure of claim 1, wherein the unitary, one-piece sole plate further includes a midfoot portion, or both a heel portion and a midfoot portion.

18. The sole structure of claim 1, wherein the unitary, one-piece sole plate is an outsole, a combination of a midsole and an outsole, or a combination of an insole, a midsole, and an outsole.

19. A sole structure for an article of footwear comprising:

a sole plate having a forefoot portion with a foot-facing surface;

traction elements protruding at a ground-facing surface of the sole plate;

wherein the sole plate has at least one groove extending at least partially transversely in the foot-facing surface and has a base portion below the at least one groove;

wherein the traction elements are forward of and rearward of the at least one groove and protrude further from the ground-facing surface than the base portion of the sole plate;

wherein the at least one groove is open when the sole structure is dorsiflexed in a first portion of a flexion range, and closed when the sole structure is dorsiflexed in a second portion of the flexion range that includes flex angles greater than in the first portion of the flexion range;

wherein the at least one groove includes a series of grooves that have at least one of different depths, different widths in a longitudinal direction of the sole plate, or different spacing from one another; and wherein a groove at a middle of the series of grooves in the longitudinal direction of the sole plate is wider than a groove at an anterior end of the series of grooves, and is wider than a groove at a posterior end of the series of grooves.

20. A sole structure for an article of footwear comprising:

a unitary, one-piece sole plate having a forefoot portion with a foot-facing surface and a ground-facing surface;

wherein the unitary, one-piece sole plate includes integral traction elements protruding at the ground-facing surface of the unitary, one-piece sole plate;

wherein the unitary, one-piece sole plate has at least one groove extending at least partially transversely in the foot-facing surface and has a base portion below the at least one groove;

a resilient material disposed in the at least one groove such that the resilient material is compressed between adjacent walls of the unitary, one-piece sole plate at the at least one groove as the sole structure is dorsiflexed;

wherein the traction elements are forward of and rearward of the at least one groove and protrude further from the ground-facing surface than the base portion of the unitary, one-piece sole plate;

wherein the at least one groove is open when the sole structure is dorsiflexed in a first portion of a flexion range, and closed when the sole structure is dorsiflexed in a second portion of the flexion range that includes flex angles greater than in the first portion of the flexion range, a bending stiffness of the sole structure in the first portion of the flexion range thereby being at least partially determined by a compressive stiffness of the resilient material;

wherein the base portion extends under the at least one groove, between the at least one groove and the ground-facing surface, and spaced apart from the foot-facing surface by the at least one groove; and tensile force at the base portion increases when the at least one groove is closed and the unitary, one-piece sole plate compresses across the at least one groove.

* * * * *